United States Patent [19]

Marsícek et al.

[11] Patent Number: 4,534,042

[45] Date of Patent: Aug. 6, 1985

[54] METHOD OF AND APPARATUS FOR THE CONTINUOUS MONITORING AND ANALYSIS OF THE OPERATION OF SPINNING UNITS IN AN OPEN-END SPINNING MACHINE

[75] Inventors: Zdeněk Maršíček; Jaroslav Janeba; Antonín Pácha; Aleš Pastrňák; Jaroslav Dykast; Roman Pražák, all of Ústí n/Orl., Czechoslovakia

[73] Assignee: Vyzkumny Ustav Bavlnarsky, Usti nad Orlici, Czechoslovakia

[21] Appl. No.: 405,927

[22] Filed: Aug. 6, 1982

[30] Foreign Application Priority Data

Oct. 24, 1981 [CS] Czechoslovakia ..... 7776-81

[51] Int. Cl.[3] ..... H03K 21/34

[52] U.S. Cl. ..... 377/16; 242/36; 57/265; 57/263; 57/404

[58] Field of Search ..... 377/16; 242/36; 57/265, 57/404, 263

[56] References Cited

U.S. PATENT DOCUMENTS

| | | | |
|---|---|---|---|
| 3,832,531 | 8/1974 | Neill et al. | 377/16 |
| 3,890,489 | 6/1975 | Felix | 377/16 |
| 3,899,665 | 8/1975 | Gaon | 377/16 |
| 4,030,082 | 6/1977 | Goto | 377/16 X |
| 4,043,107 | 8/1977 | Gunther et al. | 57/265 |
| 4,078,737 | 3/1978 | Rehr | 377/16 X |
| 4,136,511 | 1/1979 | Raasch | 57/265 |
| 4,180,724 | 12/1979 | Councilman et al. | 377/16 |
| 4,246,748 | 1/1981 | Artzt et al. | 57/265 |

*Primary Examiner*—John S. Heyman

[57] ABSTRACT

Method of and apparatus for a continuous monitoring and analysis of spinning units operation in multiple unit open-end spinning machine. The invention permits the obtaining of reliable data about the operation of open-end spinning units in the machine, and of immediately processing them in the form of an analysis of the total performance of one or a plurality of machines. The active or inactive state of operation of the individual spinning unit is detected by a continuous monitoring of the spinning units at predetermined intervals consisting in emitting checking signals by a timing pulse generator of the monitor to those units. The signals thus obtained are used for analyzing the active state of the spinning units, the inactive state of the spinning units, the analysis of the active or inactive state of spinning units on each side of the machine, and an analysis of the production rate of the machine.

8 Claims, 7 Drawing Figures

Figure 2A:
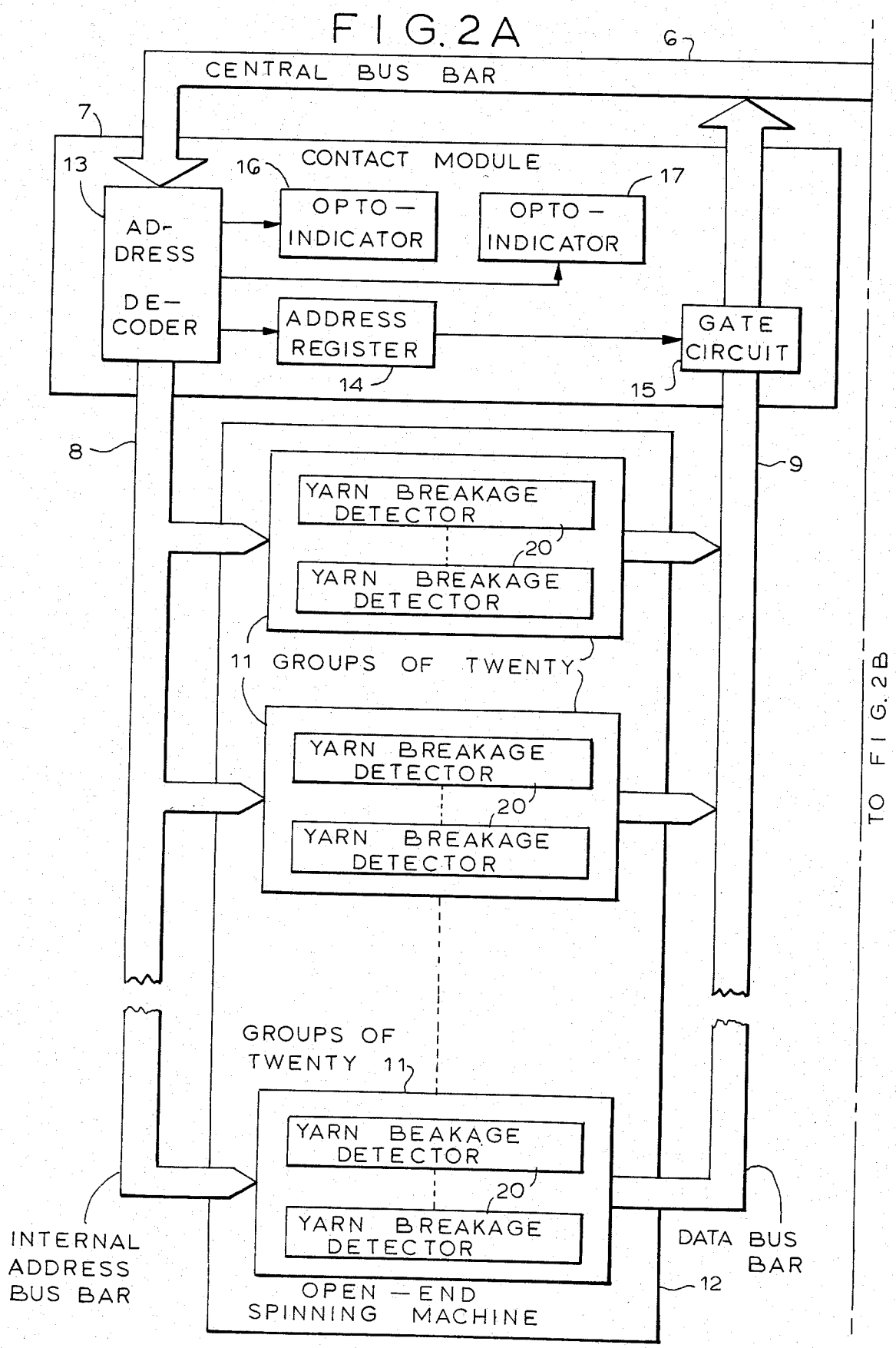
Figure 2B:
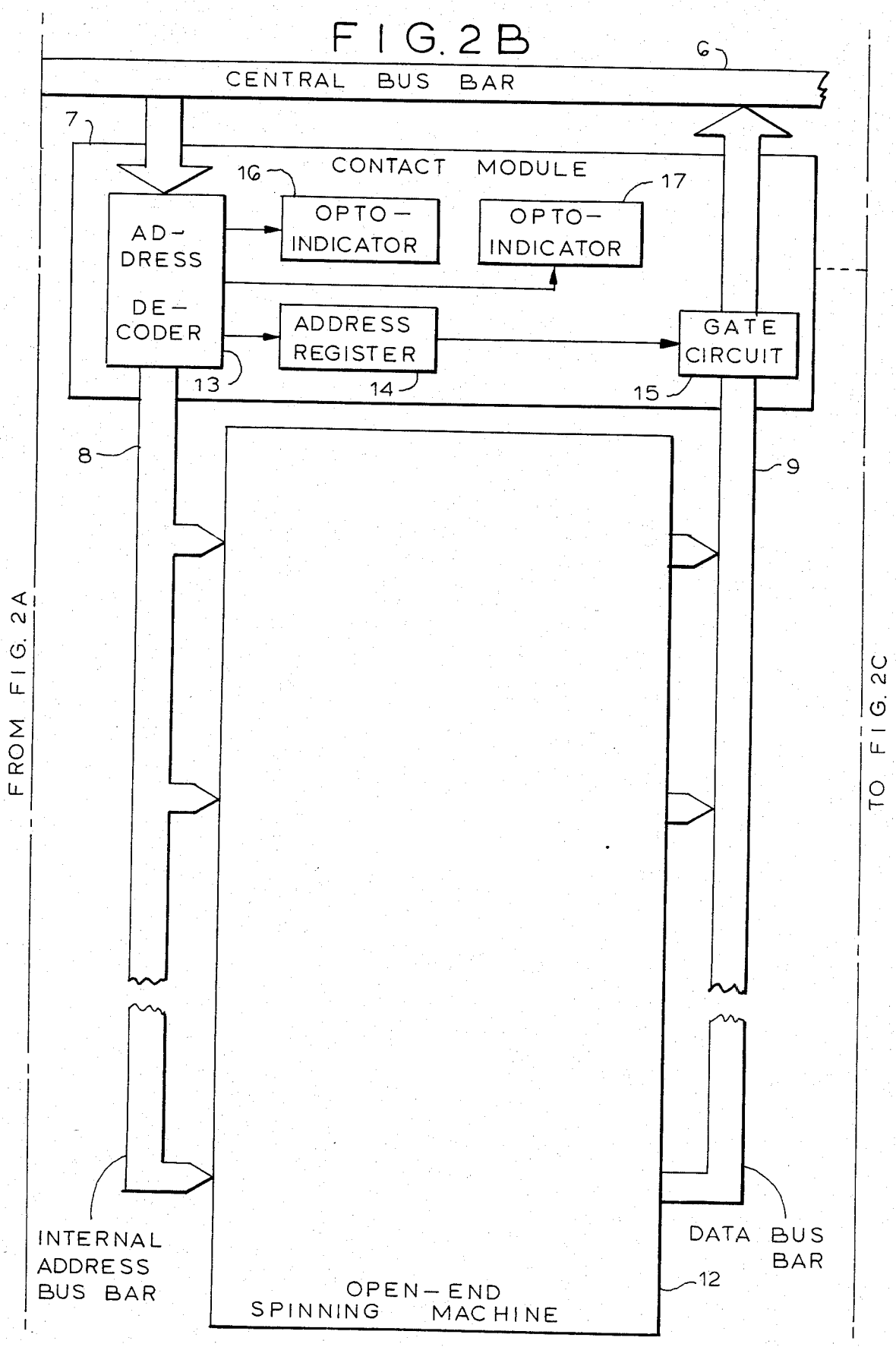
Figure 2C:
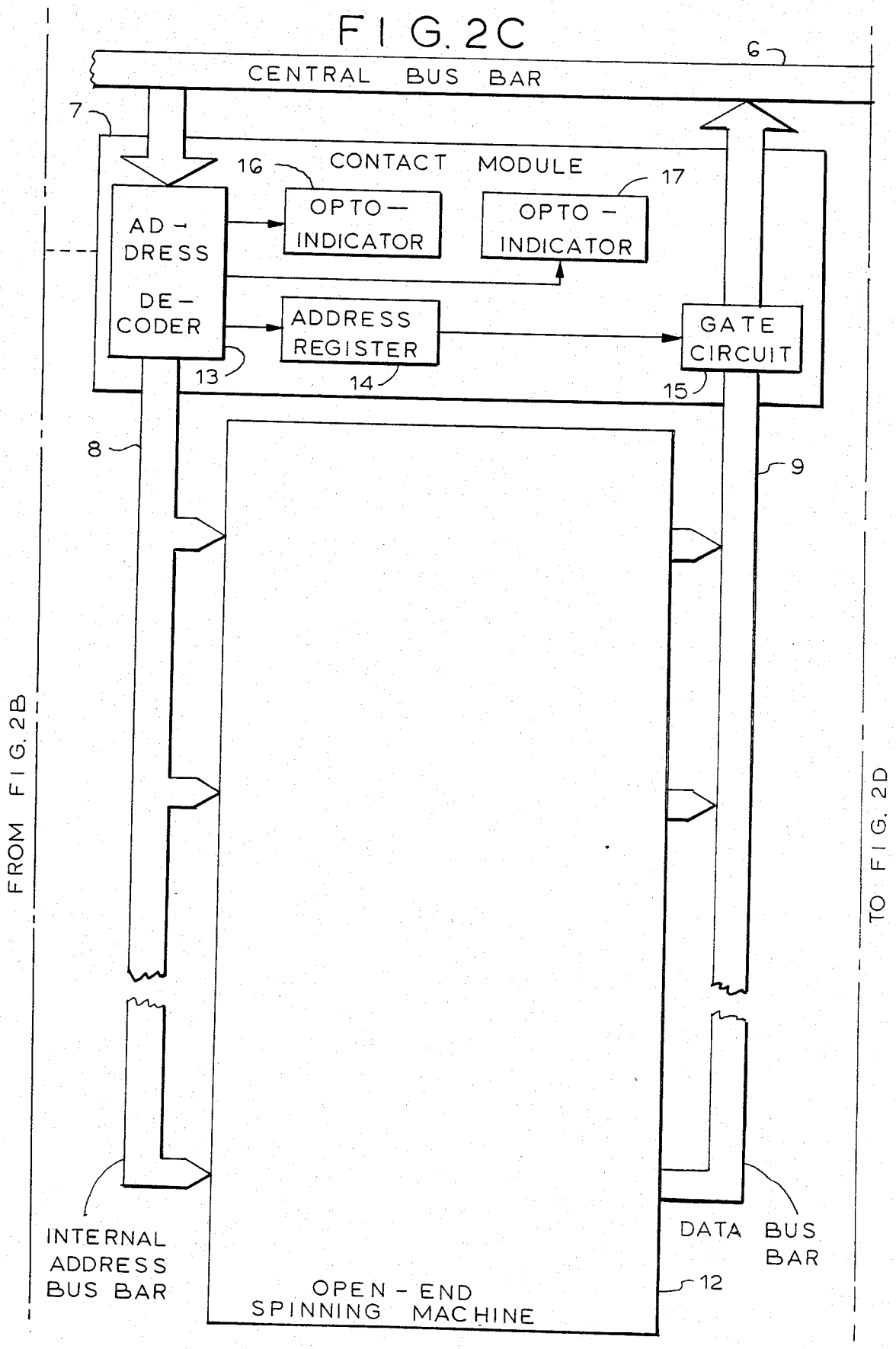
Figure 2D:
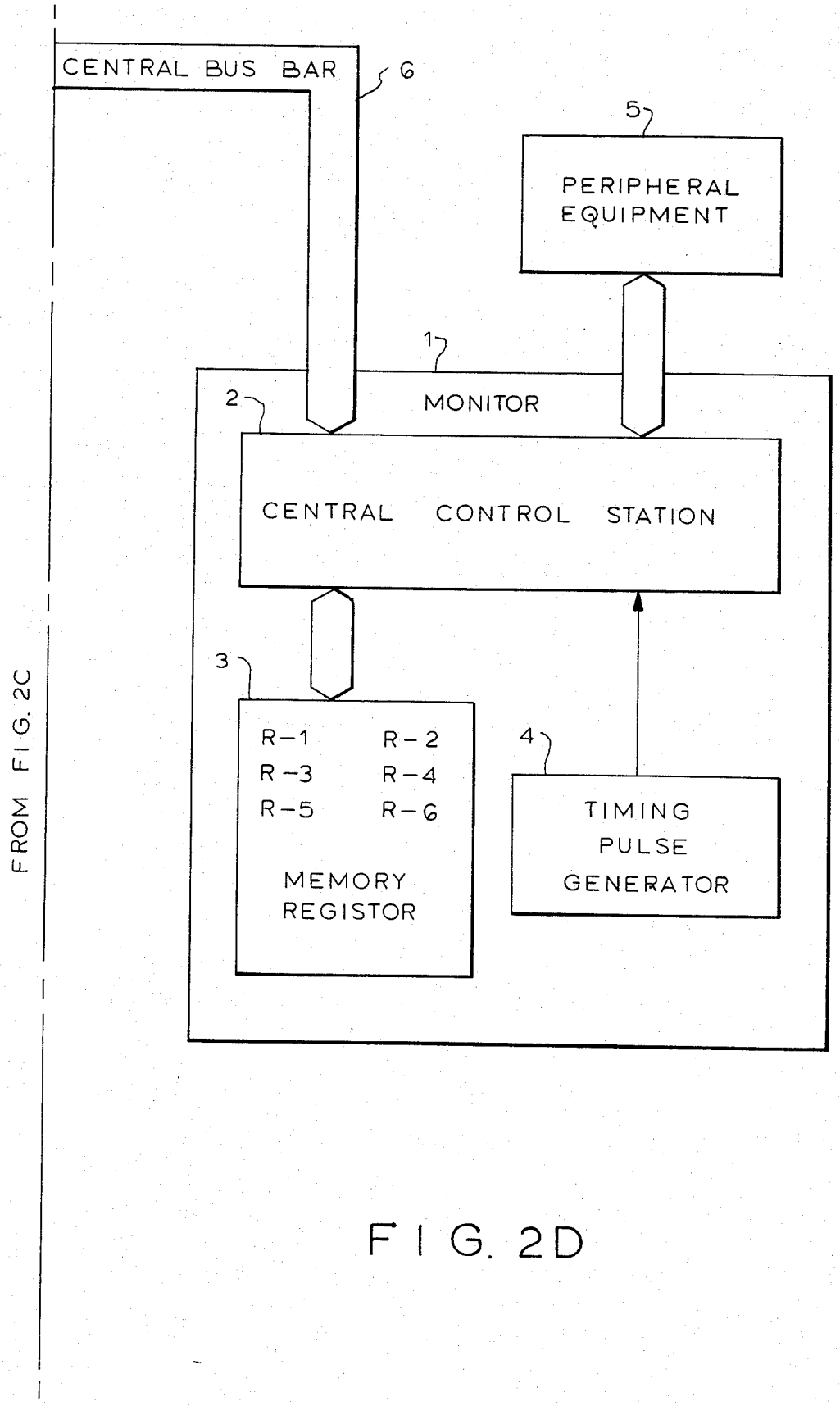

CENTRAL BUS BAR
6
7
CONTACT MODULE
16
17
AD-DRESS DE-CODER
OPTO-INDICATOR
OPTO-INDICATOR
ADDRESS REGISTER
GATE CIRCUIT
13
14
15
8
9
FROM FIG. 2A
TO FIG. 2C
INTERNAL ADDRESS BUS BAR
DATA BUS BAR
12
OPEN-END SPINNING MACHINE

METHOD OF AND APPARATUS FOR THE CONTINUOUS MONITORING AND ANALYSIS OF THE OPERATION OF SPINNING UNITS IN AN OPEN-END SPINNING MACHINE

The invention relates to a method of and an apparatus for the continuous monitoring and analysis of the operation of spinning units in an open-end spinning machine.

Such spinning units are equipped with means for feeding a fiber sliver and means for separating fibers from said sliver as well as with measn for spinning yarn from said separated fibers; such yarn is taken-up and wound on a bobbin by delivery rollers and winding rollers.

Because of the steady increase in the speed of operation of open-end spinning machines, there is an increase in the absolute number of yarn breakages in the individual spinning units. It appears that an increasing yarn production also demands that a higher attention be given to the monitoring of the yarn breakage rate in the spinning units of the machines attended to, in order to ascertain the number of inoperative spinning units, and the production obtained in a unit time, e.g. per shift or the like. Thus with a relatively large number of machines to be attended to, the situation becomes uncontrollable; this results in a relatively large increase in the rate of rejections of the yarn produced, or in the production of bobbins with too many piecings, or unequal bobbins which have to be rewound. It is known that most of such bobbins need not be rewound if it had been possible to subject the yarn to an analysis during the sprinning process, and to classify it with regard to the number of piecings.

For the classification of yarn during the spinning process many types of measuring instruments have been developed which can be installed in individual spinning units and which are adapted to respond to deviations in yarn evenness within predetermined limits. In practice, however, it has been found that it would be too expensive to provide all the spinning units in the machines with such instruments, so that the use thereof has been reduced to subsequent processing steps only.

According to Swiss Patent Specification No. 603,841, it is known to detect yarn breakages in individual units in order to ascertain the yarn breakage rate at different speeds of operation and consequently to determine an optimum speed suitable for the attendance. In this system there is employed a counter of positions, which is adapted to travel along a circular guideway around the machine, and which releases signals within one minute intervals; each spinning unit is associated with a measuring station while an evaluating station is supplied with data about only those units in which a yarn breakage has occurred.

Due to its excessive complexity and expensiveness, however, such an apparatus has not been found to be of use in practice since a known process is preferred, wherein the yarn breakage rate on a selected machine per unit time is ascertained and the operator writes down each breakage and then calculates on such basis the total number of breakages per 1000 spindle/hours.

Another method of ascertaining an excessive yarn breakage rate in individual open-end spinning units is based upon the use of a travelling unit (French Pat. No. 2,360,697 equivalent U.S. Pat. No. 4,136,511) which unit, during its travel along the row of spinning units equipped with individual thread breakage counters, detects those spinning units wherein a predetermined limit value of the number of breakages has been exceeded. This single-purpose system, because of its limited function, has been found too expensive to be used for practical purposes.

It is among the objects of the invention to provide an improved, economical solution for procuring relevant information on the operation of spinning units of open-end spinning machines by continuously monitoring and analyzing this function.

This object is achieved by a method of and an apparatus for the continuous monitoring and analysis of the operation of spinning units in an open-end spinning machine, which units are equipped with a fiber feeding mechanism comprising an electric circuit for switching on and off a supply of fibers into the individual units. The method of the invention comprises detecting an active or inactive state of operation of the individual spinning units by a predetermined short-time breaking of the electric circuit of their respective fiber feeding mechanism, and by counting the thus obtained checking signals for a subsequent analysis.

The analysis of the counted checking signals about the active state of operation of each spinning unit is preferably carried out by continuously comparing the counter time thus obtained with a time limit necessary for obtaining the full winding of spun yarn onto a bobbin, and emitting a signal when said time limit is reached.

The analysis of the counter checking signals about the inactive state of operation of each spinning unit, due to a yarn breakage, consists in comparing said signals with a predetermined yarn breakage limit whereby each excess breakage over this limit is signalled.

The analysis further consists in that at each of the two sides of the open-end spinning machine, the checking signals about momentarily inactive spinning units are continuously counted, whereby a total amount of such inactive units is signalled separately for each side of the machine. According to the invention, it is advantageous to count the checking signals from active spinning units in the machine and to compare the output of said units with target optimal indices of the production parameters of the machine.

For carrying out the method there is provided an apparatus the nature of which consists, according to the invention, in that on the electric circuits of the fiber feeding mechanisms of a group of the spinning units there is provided an inlet connection of an address bus bar through selective conductors, while an outlet connection is provided on the individual electric circuits of the fiber feeding mechanisms of the spinning units of each of the groups by means of a data bus bar, said two address bus bars being connected with a monitor through a contact module and a bidirectional central bus bar.

The monitor preferably comprises a central station, memory registers, a timing pulse generator and peripheral equipment.

In a preferred embodiment, the contact module consists, on the one hand, of an address decoder and an address register for the inlet connection of a given machine and the given group of spinning units to the monitor and, on the other hand, of a gate circuit for the outlet connection of individual electric circuits of the fiber feeding mechanisms of the given group to the monitor through the bidirectional central bus bar.

The principle of monitoring the operation of spinning units is considerably simplified by the monitoring system of the invention, since it makes a relatively expensive installation of thread breakage counters on individual spinning units unnecessary. Such counters are replaced by centrally functioning memory registers. It is also possible to omit any auxiliary unit adapted to travel along the row of spinning units in the machine and designed for detecting the state of operation thereof; such units are replaced, according to the invention, by a reliable stationary connection of the monitoring system to some of the electric circuits of the fibers feeding mechanism, such as, for example, the circuit of a thread breakage feeler, the circuit of an electromagnetic feed clutch, or the like.

Thus the monitoring system of the invention makes it possible to obtain, within short-time, e.g. ten-second intervals, continuous binary checking signals from each of the spinning units in the machine, said signals informing the operator whether the monitor spinning units is active or inactive.

Figure 1:
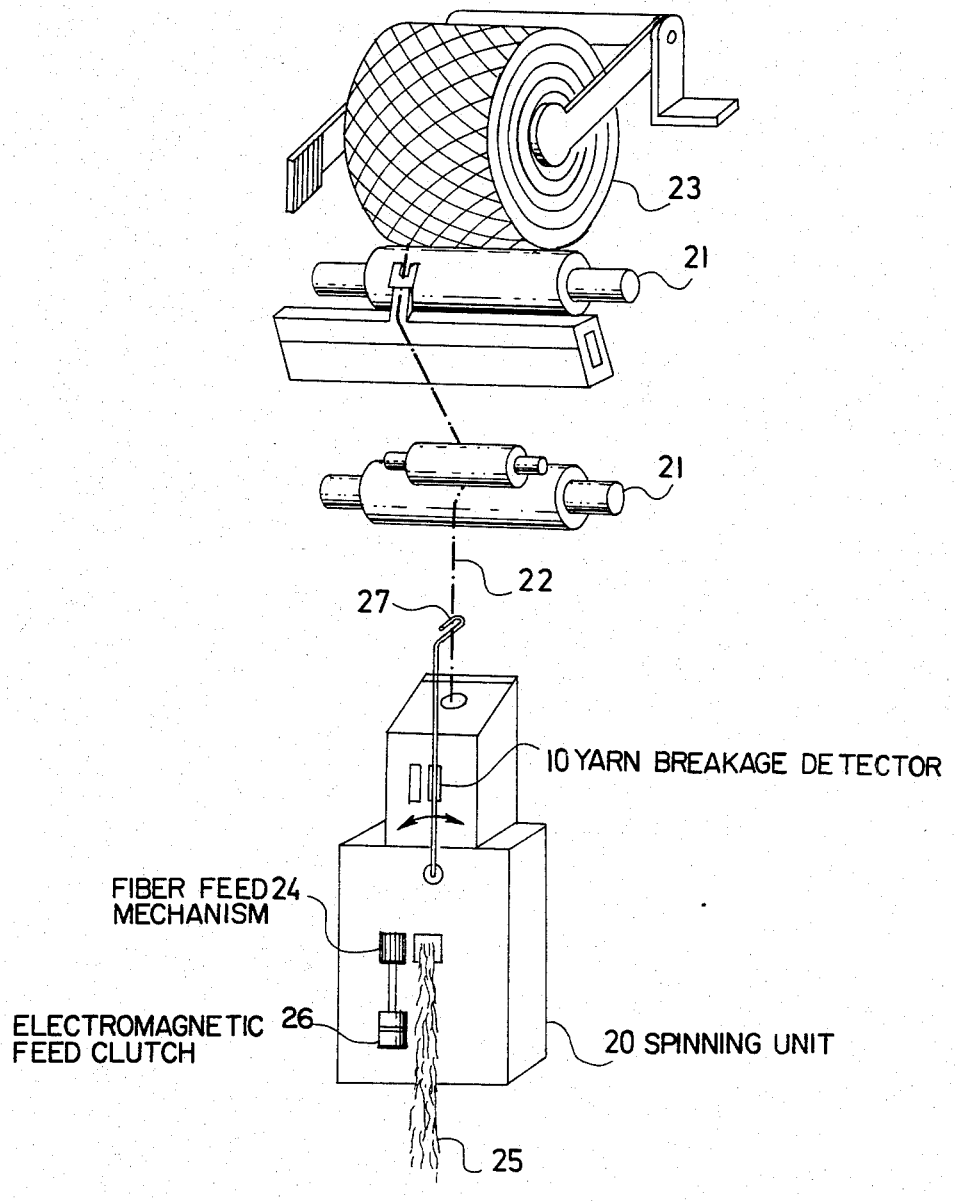
Figure 3A:
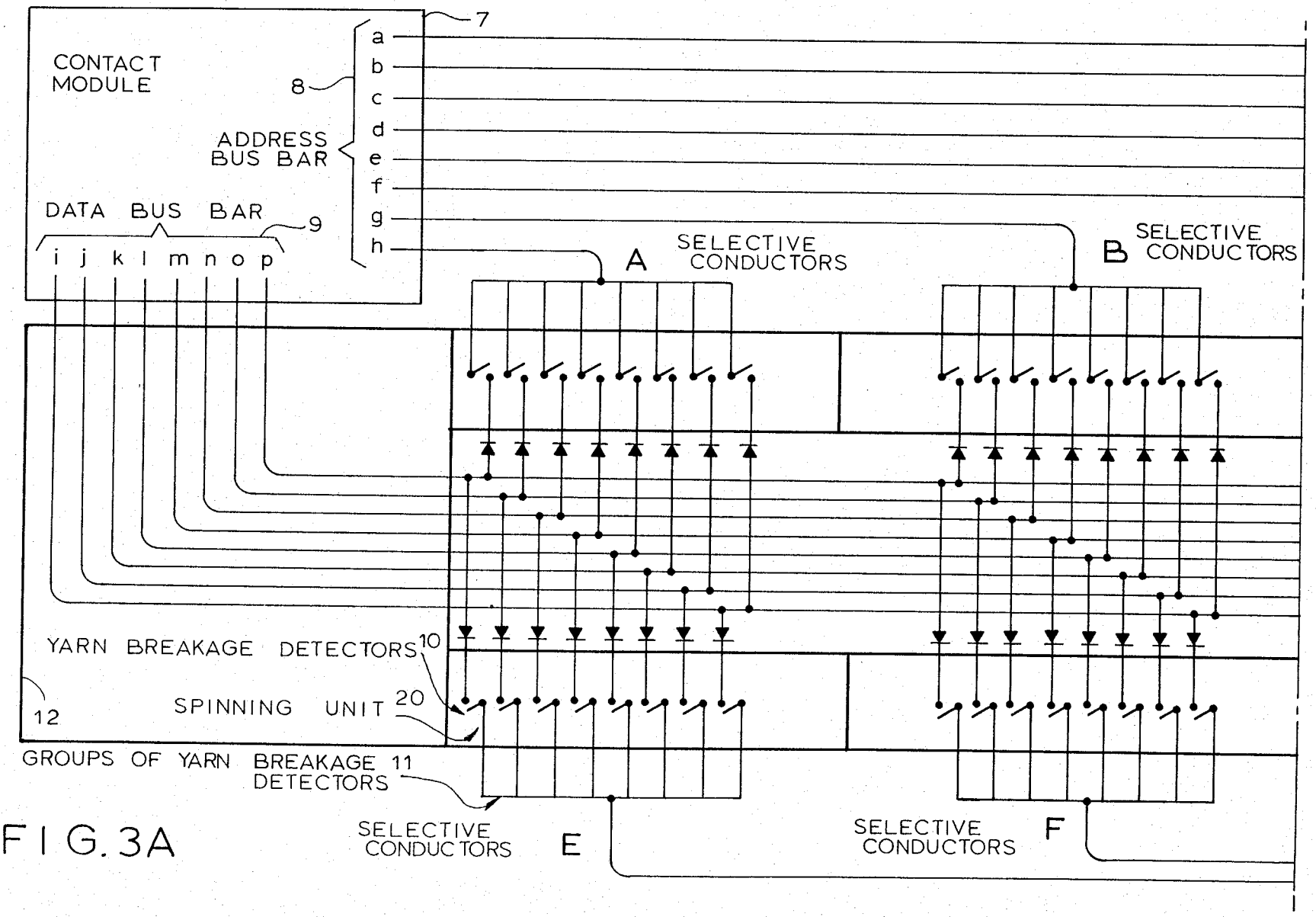
Figure 3B:
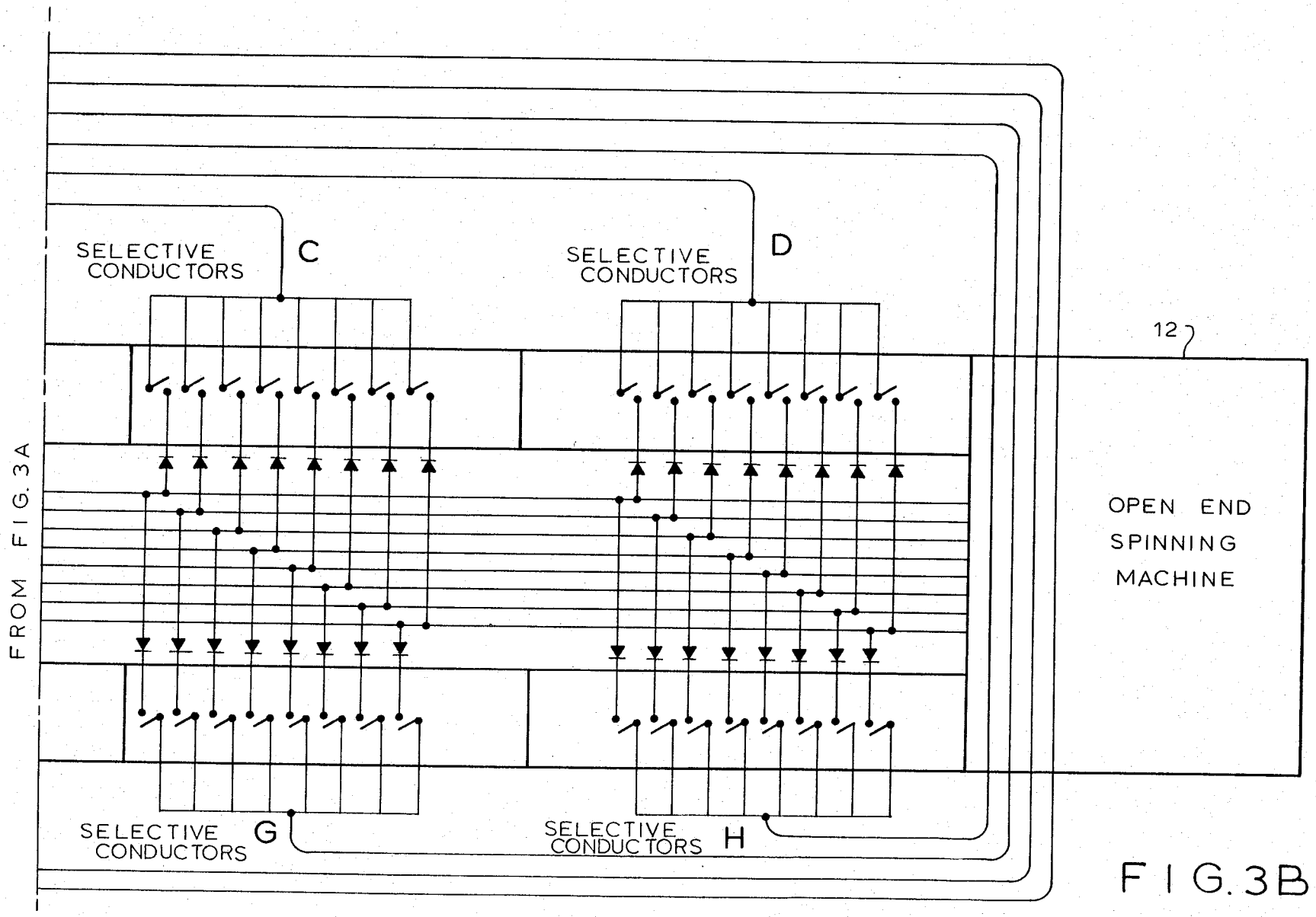

A preferred embodiment of the apparatus will hereinafter be described with reference to the accompanying schematic drawings, wherein:

FIG. 1 is a perspective view of a complete spinning unit;

FIGS. 2A, 2B, 2C, and 2D constitute parts, designed to be serially connected, as indicated, of a wiring diagram showing the connection of the individual spinning unit groups to the monitoring system, FIGS. 2A–2D being collectively referred to hereinafter as FIG. 2, and FIGS. 3A and 3B constitute parts, designed to be serially connected, as indicated, of a detailed wiring diagram showing the connection of the spinning unit to the contact module, FIGS. 3A and 3B being collectively referred to hereinafter as FIG. 3.

As can be seen in FIG. 1, each spinning station comprises a spinning unit 20 and a yarn takeoff and takeup device 21 by which yarn 22 produced in the spinning unit 20 is withdrawn and wound on a bobbin 23, respectively. In an exemplary embodiment, the spinning unit 20 is equipped with a fiber feed mechanism 24 for supplying a fiber sliver 25. The electric circuit of said feed mechanism 24 incorporates an electromagnetic feed clutch 26 and a yarn breakage detector 10 which latter is adapted to switch said clutch 26 on and off by means of its swing arm 27. In the course of a spinning process, said arm 27 bears upon the withdrawn yarn 22 whereby the electric circuit of the electromagnetic feed clutch 26 is maintained in its on position.

An open-end spinning machine 12, as shown in FIGS. 2 and 3, comprises a plurality of spinning units 20 with yarn breakage detectors 10 interconnected in groups 11 which groups are connected through selective conductors A–H to an address bus bar 8. Additionally, said yarn breakage detectors 10 are parallel-connected to a data bus bar 9. The respective outputs a–h and i–p of said two bus bar 8 and 9 are connected to a contact module 7. The individual contact modules 7 are connected through a bidirectional central bus bar 6 to the actual monitor 1 of a monitoring system. The entire monitoring system can be arranged either in an open-end spinning machine 12, or outside the machine, and can monitor even a plurality of machines, as can be seen in FIG. 2.

The continuous monitoring of the spinning units 20 at predetermined intervals consists, in an exemplary embodiment, in emitting checking signals by a timing pulse generator 4 of the monitor 1 successively to individual groups 11 of yarn breakage detectors 10 so as periodically to break the electric circuit of the feed mechanism 24 via selective conductors A–H, as well as in receiving such signals via data bus bar 9. The advantage of such a simplified connection of the spinning units 20 to the monitoring system appears in FIG. 3, which shows that for sixty-four spinning units 20 only sixteen conductors of the address bus bar 8 and the data bus bar 9 are necessary.

In an exemplary embodiment, the monitor 1 incorporates a central control station 2, memory registers 3, a timing pulse generator 4 and a set of peripheral equipment 5. The latter can comprise means allowing the input and output of data into and out of the central control station 2 for display, a printer, an external memory, or the like.

By means of said bidirectional central bus bar 6, the monitor 1 is connected to the contact modules 7 associated with each of the machines 12. The contact module 7 incorporates an address decoder 13, an internal address bus bar 8, a data bus bar 9, an address register 14 constituted by flip-flop circuits, and a gate circuit 15. For signalling purposes, the contact module 7 can be further equipped with optoindicators 16 and 17 which are connected to memory registers R-5 and R-6 and are designed for giving signals to the attendance indicating where at the respective machine side there is the highest number of inactive spinning units, or for indicating the machine, or its side, respectively, which has an overlimit number of inactive spinning units.

In an exemplary embodiment, the spinning units 20 are divided into groups 11, each group 11 being associated with one common selective conductor A–H to which a particular address is allocated, and which is activated by a signal transmitted from the monitor 1 to the address bus bar 8. As apparent from FIG. 3, the plurality of similar spinning units 20 are connected by their yarn breakage detectors 10 in the electric circuit to one and the same common conductor of the internal data bus bar 9.

For the analysis of operation of each of the spinning units 20 there are reserved in the monitor 1 six memory registers 3 of which:

Register R-1 stores the state of the spinning unit 20 in the last but one $(t-1)$ cycle;

Register R-2 stores the number of detected yarn breakages in each of the spinning units;

Register R-3 stores the number of test cycles wherein the respective spinning units has been evaluated as an active one;

Register R-4 stores the number of test cycles wherein the spinning unit has been evaluated as an active one since the last yarn breakage; after each yarn breakage, the register R-4 is cleared;

Register R-5 stores the number of spinning units detected in the last test cycle as inactive ones at the right-hand side of the machine; and Register R-6 stores the same date as register R-5 but at the lefthand side of the machine.

The data in the memory registers are summarized after each test cycle.

An exemplary embodiment of the monitoring system operates as follow:

(1) The timing pulse generator 4 of the monitor 1 continuously transmits time pulses to the central control station 2 at predetermined times which are spaced, for instance, by from 0.1 second to 15 seconds.

(2) After the receipt of a time pulse, the central control station 2 will transmit an address to the central bus bar 6 in the form of signals which are evaluated by all of the contact modules 7 through their address decoders 13. In the module 7, where the transmitted address corresponds to the present address, the address register 14 constituted e.g. by flip-flop circuits, will flip to its other stable condition. Thereby this module 7 becomes active and enables the central control station to address the individual groups of spinning units of individual groups 11 of their thread breakage circuits, respectively.

(3) Each group 11 has its own address on its own selective conductor A–H, respectively, which is activated by the transmission of the respective address.

(4) The signal produced by such an activation is supplied by said conductor to the complete group 11 where it is modified depending upon the state of the individual spinning units (operative-inoperative) of the given group, whereby the internal data bus bar 9 is influenced; the latter then leads the modified signals to the inlet circuitry of the central control station 2 through the gate circuit 15 and the central bus bar 6.

(5) During the subsequent time pulse, the state of the group 11 of spinning units is read and compared in the memory register 3 with the state of said group of spinning units in the preceding test cycle.

(6) With the individual memory registers the following modifications occur:

- R-1 is supplied with a new state of the respective spinning unit 20 or of its yarn breakage detector 10 of electrical supply circuit, which detector transforms this state into a signal form;
- R-2 in case the spinning unit has been active in the preceding test cycle (t−1) while in the last test cycle (t) it is inactive, the register storage will rise by +1;
- R-3 in case the spinning unit is active, the storage will rise by +1;
- R-4 in case the spinning unit is active the storage rises by +1, but in case a yarn breakage has occurred in the spinning unit the storage is cleared;
- R-5 the storage rises by +1 in case an inactive spinning unit has been detected at the righthand side of the machine;
- R-6 the storage rises in case an inactive spinning unit had been detected at the lefthand side of the machine.

(7) After ascertaining the state of the active and the inactive units of a given group 11 there are evaluated in the same way the other groups of spinning units of the respective machine 12.

(8) The central control station of the monitor 1 then addresses the contact module 7 of another machine 12 and stores successively the ascertained states of the groups 11 of electric circuits of thread breakage detectors 10 of the spinning units 20 into the memory registers 3 until information has been obtained about the states of operation of all the units monitored by the monitoring systems.

By means of the periphery equipment 5 and the optoindicators 16 and 17, the monitoring system of the exemplary embodument is capable of analyzing the operation of the spinning units and to give very desireable information about the effective rates of output, production, and yarn breakage.

By connecting the memory registers R-2 to an appropriate periphery equipment, it is made possible to compare the actual yarn breakage rate in the individual spinning units with a predetermined limit value, and to signal each excess over said limit in a known manner.

By means of the memory registers R-3 it is possible to ascertain with each of the spinning units an uninterrupted spinning time and to signal, by means of a periphery equipment 5, every excess over the predetermined limit value.

Although the invention is illustrated and described with reference to a preferred embodiment thereof, it is to be expressly understood that it is in no way limited to such preferred embodiment but is capable of numerous modifications within the scope of the appended claims.

We claim:

1. A method for a continuous monitoring and analysis of the operation of spinning units in multiple unit open-end spinning machine, each unit being equipped with a fiber feeding mechanism, comprising switching on and off an electric circuit which governs the supplying of fibers into the individual spinning units, monitoring an active or inactive operation state of the said individual spinning units by a continuous sampling with scanning checking signals that cause a predetermined short-time breaking of the said electric circuit which governs their fiber feeding mechanism, and counting thus obtained different information checking signals for a subsequent analysis of the number of active and inactive spinning units for the machine.

2. A method as claimed in claim 1, comprising carrying out the analysis of the counted checking signals about an active operation state of each spinning unit by continuously comparing the counter time thus obtained with a time limit necessary for obtaining full winding of spun yarn onto a bobbin, whereby the reaching of the said time-limit is signalled.

3. A method as claimed in claim 1, wherein the analysis is carried out by counting the checking signals about an inactive operation state of the spinning unit, due to a yarn breakage, and by comparing said signals with a predetermined yarn breakage limit, whereby each excess over this limit is signalled.

4. A method as claimed in claim 1, wherein at each of the two sides of the open-end spinning machine, the checking signals about momentarily inactive spinning units are continuously counted, whereby a total amount of such inactive units is signalled separately for each side of said machine.

5. A method as claimed in claim 1, wherein by counting the checking signals from active spinning units in the machine, the output of said units is compared with traget optimum indices of the production parameters of the machine.

6. An apparatus for the continuous monitoring and analysis of spinning units operation in multiple unit open-end spinning machine, such units being equipped with a fiber feeding mechanism comprising supply into the individual spinning units by means of an electromagentic feed clutch controlled by a yarn breakage feeler, electric circuit means for the fiber feeding mechanisms of a group of the spinning units comprising an inlet connection formed of an address bus bar through selective conductors, an outlet connection means coupled to the individual electric circuits of the fiber feeding mechanism of the spinning units of each of the groups by means of a data bus bar, said two bus bars being connected with a monitor through a contact module and a bidirectional central bus bar.

7. An apparatus as claimed in claim 6, wherein the monitor consists of a central control station, memory registers, a timing pulse generator and peripheral equipment cooperating to perform the monitoring operation.

8. An apparatus as claimed in claim 6, wherein the contact module comprises, an address decoder and an address register for the inlet connection of a given machine and the given group of spinning units to the monitor, and, a gate circuit for the outlet connection of individual electric circuits of the fiber feeding mechanisms of the given group to the monitor through the bidirectional central bus bar.

* * * * *